US007343980B2

(12) United States Patent
Pahila

(10) Patent No.: US 7,343,980 B2
(45) Date of Patent: Mar. 18, 2008

(54) ENHANCED PROTECTION EXTENDED COVERAGE PENDENT FIRE PROTECTION SPRINKLER

(75) Inventor: Oliver S. Pahila, Simpsonville, SC (US)

(73) Assignee: The Reliable Automatic Sprinkler Co., Inc., Elmsford, NY (US)

( * ) Notice: Subject to any disclaimer, the term of this patent is extended or adjusted under 35 U.S.C. 154(b) by 0 days.

(21) Appl. No.: 11/417,851

(22) Filed: May 4, 2006

(65) Prior Publication Data

US 2007/0256843 A1 Nov. 8, 2007

(51) Int. Cl.
*A62C 37/08* (2006.01)

(52) U.S. Cl. ..... 169/37; 169/41; 169/57; 169/42; 239/498; 239/504

(58) Field of Classification Search ..... 169/37, 169/41, 57; 239/498, 504, 518, 524
See application file for complete search history.

(56) References Cited

U.S. PATENT DOCUMENTS

| | | | | |
|---|---|---|---|---|
| 316,581 | A * | 4/1885 | Stratton | 169/37 |
| 466,658 | A | 1/1892 | Cumnock et al. | |
| 720,013 | A | 2/1903 | Esty | |
| 733,646 | A | 7/1903 | Hibbard | |
| 776,614 | A | 12/1904 | Phelps | |
| 1,498,139 | A | 6/1924 | Williams | |
| 2,076,483 | A | 4/1937 | Rowley | |
| 2,135,138 | A | 11/1938 | Kendall | |
| 2,211,399 | A | 8/1940 | Winslow | |
| 2,389,333 | A | 11/1945 | Tyden | |
| 2,534,066 | A | 12/1950 | Rowley | |
| 2,697,008 | A | 12/1954 | Rowley | |
| 3,051,397 | A | 8/1962 | Hanson | |
| 3,346,051 | A | 10/1967 | Merdinyan | |

(Continued)

FOREIGN PATENT DOCUMENTS

EP 0759794 * 3/1997

(Continued)

OTHER PUBLICATIONS

Pendent Sprinkler has 25.2 K-factor. Apr. 9, 2003, http://news.thomasnet.com/fullstory/21191.

(Continued)

*Primary Examiner*—Dinh Q. Nguyen
(74) *Attorney, Agent, or Firm*—Fitzpatrick, Cella, Harper & Scinto

(57) ABSTRACT

An enhanced protection extended coverage pendent fire protection sprinkler has a body including a fluid passage and an output orifice sealed with a seal cap, two arms extending from the body and meeting at a hub, a release mechanism with a thermally-responsive element positioned between the seal cap and the hub, and a deflector positioned on the hub and facing the output orifice. The deflector includes a pair of aligned slots, aligned with a plane of the arms, and a pair of perpendicular slots, perpendicular to the aligned slots and having a width that is less than that of the aligned slots. The deflector further includes a pair of corner slots, positioned between the aligned slots and the perpendicular slots. Angled slots are positioned between the aligned slots and the corner slots and between the perpendicular slots and the corner slots.

32 Claims, 2 Drawing Sheets

U.S. PATENT DOCUMENTS

| | | | | | |
|---|---|---|---|---|---|
| 3,561,537 | A | | 2/1971 | Bix | |
| 3,682,251 | A | | 8/1972 | Livingston | |
| 3,874,455 | A | * | 4/1975 | Klesow | 169/19 |
| 4,014,388 | A | | 3/1977 | Anderson | |
| 4,091,873 | A | | 5/1978 | Werner | |
| 4,099,675 | A | | 7/1978 | Wohler et al. | |
| 4,273,195 | A | | 6/1981 | Fischer et al. | |
| 4,296,815 | A | | 10/1981 | Mears | |
| 4,580,729 | A | | 4/1986 | Pounder | |
| 4,711,399 | A | | 12/1987 | Rosenberg | |
| 4,732,216 | A | | 3/1988 | Polan | |
| 4,757,865 | A | | 7/1988 | Simons | |
| 4,830,115 | A | | 5/1989 | Polan | |
| 4,923,013 | A | | 5/1990 | De Gennaro | |
| 5,020,601 | A | | 6/1991 | Retzloff et al. | |
| 5,072,792 | A | | 12/1991 | Simons et al. | |
| 5,152,344 | A | | 10/1992 | Fischer et al. | |
| 5,203,416 | A | | 4/1993 | Takeuchi et al. | |
| 5,366,022 | A | * | 11/1994 | Meyer et al. | 169/37 |
| 5,372,203 | A | | 12/1994 | Galaszewski | |
| 5,392,993 | A | | 2/1995 | Fischer | |
| 5,579,846 | A | | 12/1996 | Meyer et al. | |
| 5,584,344 | A | | 12/1996 | Meyer et al. | |
| 5,609,211 | A | | 3/1997 | Meyer et al. | |
| 5,632,339 | A | | 5/1997 | Fenske et al. | |
| 5,664,630 | A | | 9/1997 | Meyer et al. | |
| 5,687,914 | A | | 11/1997 | Bosio et al. | |
| 5,829,684 | A | | 11/1998 | Fishcer | |
| 5,839,667 | A | | 11/1998 | Fishcer | |
| 5,862,994 | A | | 1/1999 | Pounder et al. | |
| 5,865,256 | A | | 2/1999 | Pounder | |
| 5,890,657 | A | | 4/1999 | Ponte | |
| 5,915,479 | A | | 6/1999 | Ponte | |
| 6,026,907 | A | | 2/2000 | Pahila | |
| 6,059,044 | A | * | 5/2000 | Fischer | 169/37 |
| 6,098,718 | A | | 8/2000 | Sato | |
| 6,276,460 | B1 | * | 8/2001 | Pahila | 169/37 |
| 6,446,732 | B1 | | 9/2002 | Polan | |
| 6,450,266 | B1 | | 9/2002 | Pahila | |
| 6,516,893 | B2 | * | 2/2003 | Pahila | 169/37 |
| 6,799,639 | B2 | | 10/2004 | Sato et al. | |
| 2002/0096580 | A1 | | 7/2002 | Pahila | |
| 2003/0111237 | A1 | | 6/2003 | Sato et al. | |
| 2005/0035022 | A1 | | 2/2005 | Ide et al. | |
| 2005/0178564 | A1 | | 8/2005 | Orr | |

FOREIGN PATENT DOCUMENTS

| | | | |
|---|---|---|---|
| EP | 0759794 B | | 7/1998 |
| EP | 0898984 | * | 3/1999 |
| GB | 1412348 | * | 11/1975 |
| GB | 2049415 | * | 12/1980 |
| GB | 2333702 | * | 8/1999 |
| GB | 2337199 | * | 11/1999 |
| JP | 2001-046544 | * | 2/2001 |
| JP | 2001046544 | | 2/2001 |
| WO | 01/54772 | | 8/2001 |
| WO | WO 01/54772 | * | 8/2001 |
| WO | 01/64289 | | 9/2001 |
| WO | WO 01/64289 | * | 9/2001 |

OTHER PUBLICATIONS

"Ordinary Hazard Group 3 Protection Using Enhanced Protection Extended Coverage Sprinklers," Technical Bulletin 222:2004:1.

"Sprinkler Protection of Concealed Spaces in OH3 EPEC Sprinklered Buildings," Technical Bulletin 223:2004:1.

Newsletter No. 19, British Automatic Sprinkler Association Limited, Mar. 2005.

"Introduction of the new EPEC sprinkler," Tyco Building Services Products, http://www.tycobuilding.com/cgi-bin/webscripts/nph-news.pl?id=1537.

"Launch Package EPEC Sprinkler," http://www.tycobuilding.com/user/PDF/FireProtection/EPEC_Launch_Internet.pdf.

Viking ESFR Pendent K25.2 Sprinkler SIN VK510, The Viking Corporation, Hastings, Michigan, Jun. 10, 2005.

* cited by examiner

ENHANCED PROTECTION EXTENDED COVERAGE PENDENT FIRE PROTECTION SPRINKLER

BACKGROUND OF THE INVENTION

1. Field of the Invention

The present invention relates to an automatic fire protection sprinkler, and in particular, an enhanced protection extended coverage, pendent sprinkler.

2. Related Art

Automatic fire protection sprinklers conventionally are connected to a conduit to receive pressurized fire-extinguishing fluid, such as water. A typical sprinkler has a base with a threaded portion for connection to the conduit and an output orifice to output the fluid to provide fire control and/or suppression. The output orifice is sealed by a seal cap, which is held in place by a release mechanism. The release mechanism is designed to release the cap under predetermined conditions, thereby initiating the flow of fire-extinguishing fluid. A typical release mechanism includes a thermally-responsive element, e.g., a frangible bulb or fusible link, and may also include a latching mechanism.

Certain conventional sprinklers have a pair of arms that extend from the base portion and meet at a hub portion to form a frame. The hub portion is spaced apart from the output orifice of the base portion and is aligned with a longitudinal axis thereof. The hub portion may have a set-screw configured to apply a pre-tension force to the release mechanism. A deflector may be mounted on the hub, transverse to the output orifice, to provide dispersion of the output fluid.

Fire protection sprinklers may be mounted on a fluid conduit running along a ceiling and may either depend downward from the conduit, which is referred to as a "pendent" configuration, or may extend upward, which is referred to as an "upright" configuration. Alternatively, a sprinkler may be mounted on a wall, a certain distance below the ceiling, which is referred to as a "horizontal sidewall" configuration. Horizontal sidewall sprinklers have an output orifice that is oriented so that the fluid is output horizontally and sprays onto an area to be protected in front of the sprinkler.

Enhanced protection extended coverage (EPEC) sprinklers are designed to meet the requirements of the Loss Prevention Certification Board (LPCB), which provides certification for sprinkler systems in the U.K. EPEC sprinklers are designed to provide protection for storage applications meeting Ordinary Hazard Group III criteria, in accordance with Technical Bulletin TB222. The relevant standards allow coverage of an area of 17.6 $m^2$, which corresponds to a sprinkler spacing of 4.2 m (about 13.8 ft). By contrast, standard (non-extended coverage) sprinklers provide a coverage area of 12 $m^2$ , which corresponds to a spacing of 3.5 m (about 11.5 ft).

SUMMARY OF THE INVENTION

In one aspect, the present invention provides an enhanced protection extended coverage pendent fire protection sprinkler has a body including a fluid passage and an output orifice sealed with a seal cap, two arms extending from the body and meeting at a hub, a release mechanism with a thermally-responsive element positioned between the seal cap and the hub, and a deflector positioned on the hub and facing the output orifice. The deflector includes a pair of aligned slots, aligned with a plane of the arms, and a pair of perpendicular slots, perpendicular to the aligned slots. The deflector further includes a pair of corner slots, positioned between the aligned slots and the perpendicular slots. Angled slots are positioned between the aligned slots and the corner slots and between the perpendicular slots and the corner slots.

Embodiments of the present invention may include one or more of the following features.

The deflector may have a radius of about 0.5-1.1 inches. The deflector may include a circular disk, with a planar central portion and edges that are angled in a direction away from an output orifice of the sprinkler, or the deflector may be flat. The central portion may have a radius of about 0.4-0.9 inches. The edges may form an angle of about 50°-30° with respect to the central portion.

The aligned slots may have a radial length of about 0.2-0.6 inches, which may be about 25-75% of a radius of the deflector. The aligned slots may have a width of between about 0.06 and about 0.10 inches.

The perpendicular slots may have a radial length of about 0.3-0.7 inches, which may be about 37-88% of a radius of the deflector. The perpendicular slots may have a width of between about 0.05 and about 0.07 inches.

The corner slots may have a radial length of about 0.4-0.7 inches, which may be about 50-88% of a radius of the deflector. The corner slots may form an angle of about 30°-65° with respect to the aligned slots.

The first plurality of angled slots have a radial length of about 0.2-0.6 inches, which may be about 25-75% of a radius of the deflector. The first plurality of angled slots may form an angle of about 15-45° with respect to the aligned slots.

The second plurality of angled slots may have a radial length of about 0.2-0.4 inches, which may be about 25-50% of a radius of the deflector. The second plurality of angled slots may form an angle of about 5-35° with respect to the perpendicular slots.

The sprinkler may achieve an actual delivered density of at least about 6.0 mm/min or at least about 6.5 mm/min over a design area of 160 $m^2$. The nominal K-factor of the sprinkler may be 8.0, 11.2, or 14.0 gpm/$psi^{1/2}$.

These and other objects, features and advantages will be apparent from the following description of the preferred embodiments of the present invention.

BRIEF DESCRIPTION OF THE DRAWINGS

The present invention will be more readily understood from a detailed description of the preferred embodiments taken in conjunction with the following figures.

DETAILED DESCRIPTION OF THE PREFERRED EMBODIMENTS

Figure 1:
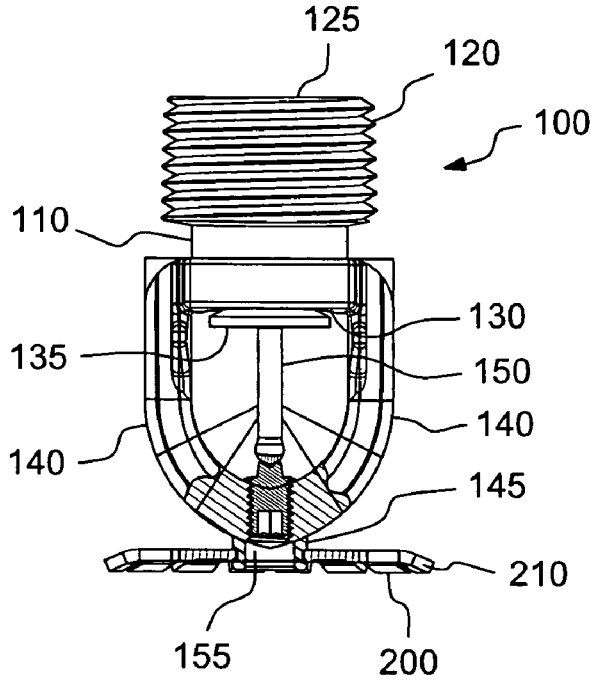
FIG. 1 is a plan view of the enhanced protection extended coverage pendent sprinkler, in accordance with the present invention.

FIG. 1 shows an enhanced protection extended coverage (EPEC) pendent sprinkler 100, in accordance with the present invention. The sprinkler 100 has a body 110 defining an axial fluid passage through the body. The top of the body has a threaded portion 120 on its outer surface to allow the sprinkler 100 to be connected to a conduit (not shown) for providing pressurized fire-extinguishing fluid, such as water, to an input end 125 of the fluid passage. The fluid passage has an output orifice 130 at the opposite end that is sealed by a seal cap 135. The input end 125 may have a diameter of, for example, ¾ inch NPT (national pipe thread). The sprinkler 100 may have a K-factor of, for example, 8.0 gpm/psi$_{1/2}$, which is defined by $K=Q/\sqrt{p}$, where Q is the flow rate in gallons per minute and p is the residual pressure at the inlet of the sprinkler in pounds per square inch (which corresponds to a metric K-factor of 1151 pm/bar$^{1/2}$). Larger K-factors, for example 11.2 gpm/psi$^{1/2}$ (1611 pm/bar$^{1/2}$) or 14 gpm/psi$^{1/2}$ (2011 pm/bar$^{1/2}$), are also possible.

Two frame arms 140 extend from the lower portion of the body 110 and meet at a hub 145 positioned below and in axial alignment with the output orifice 130. A deflector 200 is positioned on the hub 145 so as to be impinged by the output fluid upon activation of the sprinkler 100. As further discussed below, the deflector 200 in this particular embodiment is a circular disk that is centered on and orthogonal to the axis of the fluid passage. The disk has a number of slots of varying length and orientation arrayed around its periphery.

A release mechanism having a thermally-responsive element, e.g., a frangible bulb 150, is positioned between the hub 145 and the seal cap 135 to hold the seal cap 135 in place over the output orifice 130. As shown in FIG. 1, the bulb 150 is positioned between the seal cap 135 and a set screw 155. The bulb 150 is designed to burst at the predetermined temperature, which in turn releases the seal cap 135 and allows the fluid to be output from the orifice 130. Of course, other types of release mechanisms may be used, including, but not limited to, for example, a fusible link assembly or a sensor, strut, and lever assembly.

Figure 2:
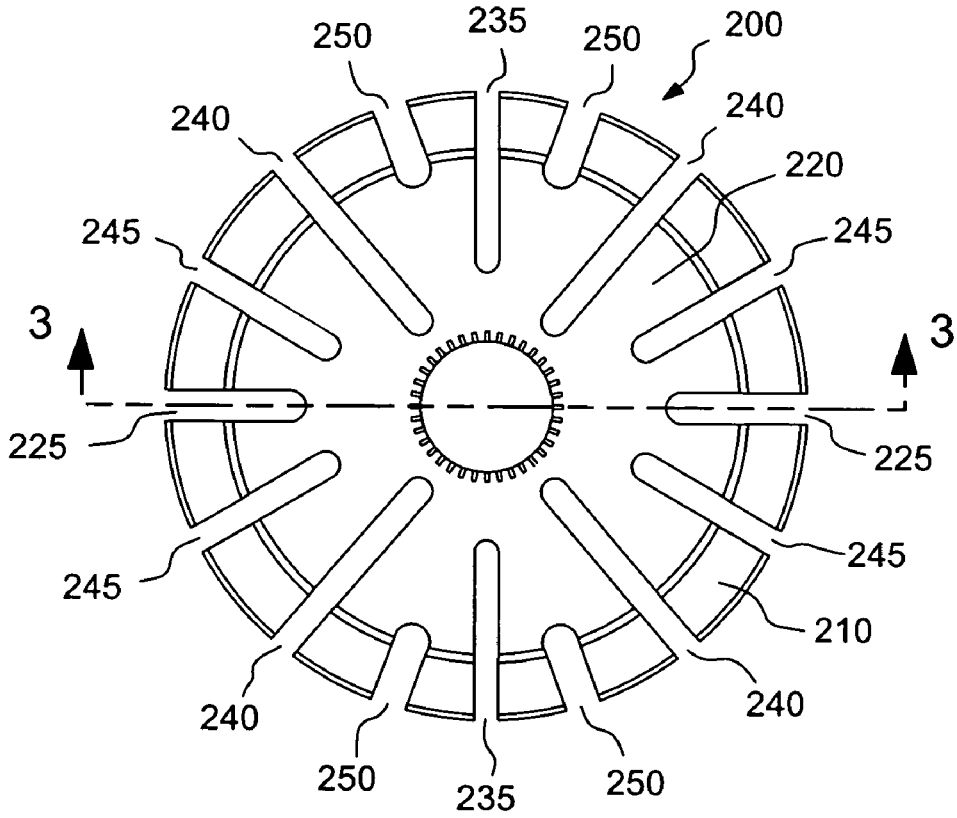
FIG. 2 is a plan view of the deflector showing the surface facing away from the outlet orifice.
Figure 3:
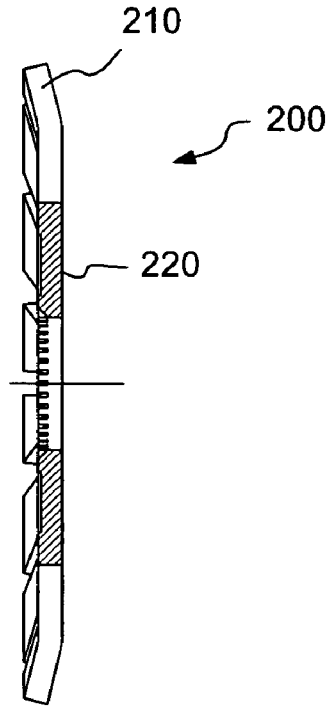
FIG. 3 is a sectional view of the deflector in the plane of the frame arms.
Figure 4:
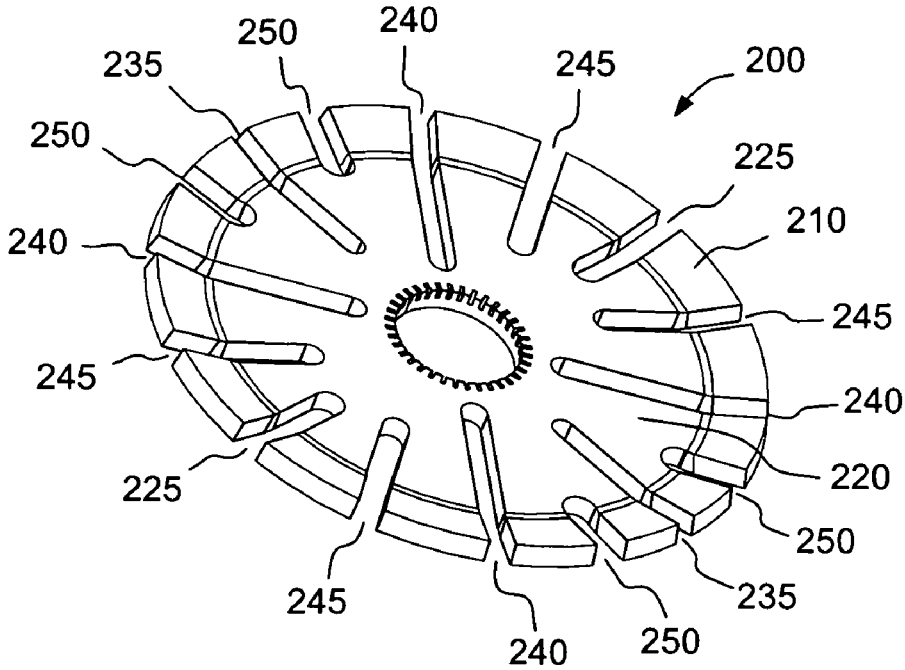
FIG. 4 is a perspective view of the deflector showing the surface facing away from the outlet orifice.

FIGS. 2-4 show an embodiment of the deflector 200, which as noted above, is a circular disk having a number of slots of varying length and orientation arrayed around its periphery. The deflector is formed of metal, such as, for example, phosphor bronze, and has a radius of about 0.8 inches and a thickness of about 0.06 inches. In alternative embodiments, the radius may be between about 0.5 and about 1.1 inches, preferably about 0.7-0.9 inches. The deflector is formed by a stamping a thin piece of metal to form a flat, circular blank (not shown) with slots. The blank may be about 0.02 inches larger in diameter than the finished deflector, due to the bending of the edges, as discussed below.

The edges of the blank are curved or bent in a further process, so that the outer edges 210 of the deflector extend away from the outlet orifice 130. For example, as shown in FIG. 3, the edges 210 of the deflector may be bent to form an angle of about 14° with respect to the plane of the deflector (this angle may be between about 5° and about 30°, preferably about 10°-20, in alternative embodiments), such that the deflector has a planar central portion 220 with a radius of about 0.65 inches. The central portion may have a radius of between about 0.4 and about 0.9 inches, preferably about 0.6-0.7 inches. Alternatively, the edges may be left flat.

The positions of the slots may be described in terms of the approximate angle between each slot and section line 3-3, which extends horizontally though the planar view of the deflector 200 in FIG. 2. In the exemplary embodiment, there is a pair of "aligned slots" 225, which are cut out along section line 3-3, and extend to the outer edge 210 of the deflector. The aligned slots 225 are aligned with the plane of the frame arms 140. The aligned slots 225 have a radial length of about 0.35 inches (which is about 44% of the deflector radius). In alternative embodiments, the length of the aligned slots 225 may be between about 0.2 and about 0.6 inches, preferably about 0.3-0.4 inches.

The width of the aligned slots is about 0.08 inches, which in alternative embodiments may vary about±20%, preferably about±15%. The width of the aligned slots is designed to provide a desired amount of additional water to the areas under the frame arms 140, i.e., the area almost directly below the sprinkler 100. This helps counteract the "shadowing effect," which is the tendency of the frame arms 140, depending upon their width, to block water output to the area below the frame arms 140. By contrast, extending the length of the aligned slots 225 toward the center of the deflector might result in a structurally weakened deflector, due to the proximity of the inner end of the aligned slots 225 to the adjacent angled slots 245.

There is a pair of "perpendicular slots" 235, which are perpendicular to section line 3-3. The perpendicular slots 235 also are perpendicular to the plane of the frame arms 140. The perpendicular slots 235 have a radial length of about 0.46 inches (which is about 58% of the deflector radius) and a width of about 0.06 inches. In alternative embodiments, the length of the perpendicular slots 235 may be between about 0.3 and about 0.7 inches, preferably about 0.4-0.5 inches. The width of the perpendicular slots may be about 0.06 inches, which in alternative embodiments may vary about 20%, preferably about ±15%.

There are four "corner slots" 240 that form an angle of about 50 ° with section line 3-3 each having a radial length of about 0.56 inches (about 70% of the deflector radius) and a width of about 0.70 inches. In alternative embodiments, the angle of the corner slots 240 may be between about 40 ° and about 60°, and the length of the corner slots 240 may be about 0.4 to about 0.7 inches, preferably about 0.5-0.6 inches. The width of the corner slots may be about 0.06 inches, which in alternative embodiments may vary about±20%, preferably about 15%.

There are four angled slots 245 ("the first angled slots") that are positioned on both sides of the aligned slots 225 and are oriented to form an angle of about 30° with respect to aligned slots 225. In alternative embodiments, the angle may be about 15°-45°, preferably about 20°-40°. The radial length of the first angled slots 245 (with respect to the center of the deflector) is about 0.4 inches (about 50% of the deflector radius), and these slots 245 have a width of about 0.70 inches. The inner ends of the first angled slots 245 are positioned at radius of about 0.4 inches. In alternative embodiments, the length of these slots 245 may be about 0.2-0.6 inches, preferably about 0.3-0.5 inches. The width may vary about ±20%, preferably about±15%.

There are an additional four angled slots 250 ("the second angled slots") that are positioned on either side of the perpendicular slots 235 and are oriented to form an angle of about 20° with respect to perpendicular slots 235. In alternative embodiments, the angle may be between about 5° and about 35°, preferably about 10°-30°. The radial length of the second angled slots 250 (with respect to the center of the deflector) is about 0.2 inches (about 25% of the deflector radius), and these slots 250 have a width of about 0.09 inches. The inner ends of the second angled slots 250 are positioned at radius of about 0.6 inches. In alternative embodiments, the length of these slots 250 may be about 0.2-0.4 inches, preferably about 0.2-0.25 inches. The width may vary about±20%, preferably about±15%.

The slots discussed above have rounded inner ends with a radius equal to about half the slot width, but other geometries may also be used for the inner ends. Of course, the deflector may have other slots in addition to those described above.

In accordance with Technical Bulletin TB222, EPEC sprinklers must be tested through measurements of actual delivered density and through commodity fire tests, in which an array of sprinklers is tested in operation over predetermined configurations of commodities. The water flow from the sprinklers must be controlled by the deflector to achieve an output pattern that meets the required actual delivered density specified for the sprinkler. Representative sample sprinklers are installed at a specified spacing for each fire test, which is either 4.0 m or 4.2 m for K-8.0 (metric K-factor 115). The required density is either 6.0 mm/min (for Ordinary Hazard Group III/10) or 6.5 mm/min (for Ordinary Hazard Group III/12.5) over a design area of 160 $m^2$, which corresponds to an array of ten sprinklers, each covering 16 $m^2$.

In order to maintain the proper density of water output over the specified area, the sprinkler must have a spray pattern that is approximately square. To achieve such a pattern, the corner slots are designed to be somewhat longer than the aligned slots and the perpendicular slots, in order to project more water toward the corners of the spray pattern. Likewise, the first and second sets of angled slots are angled toward the corner of the output pattern, which further tends to create a square pattern. In addition, directing the output spray toward the corner of the spray pattern lessens the amount of water output toward adjacent sprinklers. This helps prevent "cold soldering," which is a condition in which water is output by a sprinkler directly onto an adjacent sprinkler, thereby lowering the temperature of the adjacent sprinkler and preventing it from properly activating.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims.

What is claimed is:

1. A pendent fire protection sprinkler, comprising a deflector that includes:

a pair of aligned slots having a width and being aligned in a first direction, a pair of perpendicular slots, perpendicular to the first direction and having a width that is less than the width of the aligned slots, a pair of corner slots, positioned between the aligned slots and the perpendicular slots, a first plurality of angled slots, positioned between the aligned slots and the corner slots, and a second plurality of angled slots, positioned between the perpendicular slots and the corner slots.

2. The pendent fire protection sprinkler of claim 1, wherein the aligned slots have a width of between about 0.06 and about 0.10 inches.

3. The pendent fire protection sprinkler of claim 1, wherein the perpendicular slots have a width of between about 0.05 and about 0.07 inches.

4. The pendent fire protection sprinkler of claim 1, wherein the aligned slots have a radial length less than that of the perpendicular slots.

5. The pendent fire protection sprinkler of claim 1, wherein the first plurality of angled slots have a radial length greater than that of the second plurality of angled slots.

6. The pendent fire protection sprinkler of claim 1, wherein the sprinkler achieves an actual delivered density of at least about 6.0 mm/min over a design area of 160 $m^2$.

7. The pendent fire protection sprinkler of claim 1, wherein the sprinkler achieves an actual delivered density of at least about 6.5 mm/min over a design area of 160 $m^2$.

8. The pendent fire protection sprinkler of claim 1, wherein the deflector comprises a flat, circular disk.

9. The pendent fire protection sprinkler of claim 1, wherein the deflector comprises a circular disk, with a planar central portion and edges that are angled in a direction away from an output orifice of the sprinkler.

10. The pendent fire protection sprinkler of claim 9, wherein the central portion has a radius of about 0.4-0.9 inches.

11. The pendent fire protection sprinkler of claim 9, wherein the edges form an angle of about 5°-30° with respect to the central portion.

12. The pendent fire protection sprinkler of claim 1, wherein the deflector has a radius of about 0.5-1.1 inches.

13. The pendent fire protection sprinkler of claim 12, wherein the aligned slots have a radial length of about 0.2-0.6 inches.

14. The pendent fire protection sprinkler of claim 12, wherein the perpendicular slots have a radial length of about 0.3-0.7 inches.

15. The pendent fire protection sprinkler of claim 12, wherein the corner slots have a radial length of about 0.4-0.7 inches.

16. The pendent fire protection sprinkler of claim 12, wherein the first plurality of angled slots have a radial length of about 0.2-0.6 inches.

17. The pendent fire protection sprinkler of claim 12, wherein the second plurality of angled slots have a radial length of about 0.2-0.4 inches.

18. The pendent fire protection sprinkler of claim 1, wherein the aligned slots have a radial length of about 25-75% of a radius of the deflector.

19. The pendent fire protection sprinkler of claim 1, wherein the perpendicular slots have a radial length of about 37-88% of a radius of the deflector.

20. The pendent fire protection sprinkler of claim 1, wherein the corner slots have a radial length of about 50-88% of a radius of the deflector.

21. The pendent fire protection sprinkler of claim 1, wherein the first plurality of angled slots have a radial length of about 25-75% of a radius of the deflector.

22. The pendent fire protection sprinkler of claim 1, wherein the second plurality of angled slots have a radial length of about 25-50% of a radius of the deflector.

23. The pendent fire protection sprinkler of claim 1, wherein the corner slots form an angle of about 30°-65° with respect to the aligned slots.

24. The pendent fire protection sprinkler of claim 1, wherein the first plurality of angled slots form an angle of about 15-45° with respect to the aligned slots.

25. The pendent fire protection sprinkler of claim 1, wherein the second plurality of angled slots form an angle of about 5-35° with respect to the perpendicular slots.

26. The pendent fire protection sprinkler of claim 1, wherein the nominal K-factor of the sprinkler is 8.0 gpm/psi$^{1/2}$.

27. The pendent fire protection sprinkler of claim 1, wherein the nominal K-factor of the sprinkler is 11.2 gpm/psi$^{1/2}$.

28. The pendent fire protection sprinkler of claim 1, wherein the nominal K-factor of the sprinkler is 14.0 gpm/psi$^{1/2}$.

29. A pendent fire protection sprinkler, comprising a body including a fluid passage and an output orifice sealed with a seal cap, two arms extending from the body and meeting at a hub, a release mechanism with a thermally-responsive element positioned between the seal cap and the hub, and a deflector positioned on the hub and facing the output orifice, the deflector comprising:

a pair of aligned slots, aligned with a plane of the arms, the aligned slots having a length and a width, a pair of perpendicular slots, perpendicular to the aligned slots and having a length that is greater than the length of the aligned slots and a width that is less than the width of the aligned slots, a pair of corner slots, positioned between the aligned slots and the perpendicular slots, and a first plurality of angled slots, positioned between the aligned slots and the perpendicular slots.

30. The pendent fire protection sprinkler of claim 29, wherein the corner slots form an angle of about 30°-65° with respect to the aligned slots.

31. The pendent fire protection sprinkler of claim 29, wherein the first plurality of angled slots form an angle of about 15-45° with respect to the aligned slots.

32. The pendent fire protection sprinkler of claim 29, further comprising a second plurality of angled slots forming an angle of about 5-35° with respect to the perpendicular slots.

* * * * *

UNITED STATES PATENT AND TRADEMARK OFFICE

CERTIFICATE OF CORRECTION

PATENT NO. : 7,343,980 B2
APPLICATION NO. : 11/417851
DATED : March 18, 2008
INVENTOR(S) : Oliver S. Pahila It is certified that error appears in the above-identified patent and that said Letters Patent is hereby corrected as shown below:

COLUMN 2:

Line 12, "50°-30°" should read --5°-30°--.

COLUMN 3:

Line 2, "8.0 gpm/psi$_{1/}$" should read --8.0 gpm/psi$^{½}$,--;
Line 3, "$_{2,}$" should be deleted;
Line 6, "1151 pm/bar$^{½}$)." should read --115 lpm/bar$^{½}$).--;
Line 7, "(1611 pm/bar$^{½}$)" should read --161 lpm/bar$^{½}$)--; and
Line 8, "(2011 pm/bar$^{½}$)," should read --(201 lpm/bar$^{½}$),--.

COLUMN 6:

Line 53, "psi/$^{½}$." should read --psi$^{½}$.--.

Signed and Sealed this

Twenty-fifth Day of November, 2008

JON W. DUDAS
*Director of the United States Patent and Trademark Office*